US005088117A

United States Patent [19]

Fulmer

[11] Patent Number: 5,088,117

[45] Date of Patent: Feb. 18, 1992

[54] VERSATILE HOSPITAL AND OUT-PATIENT GOWN

[76] Inventor: Dorothy A. Fulmer, 3800 Liberty Way, McKeesport, Pa. 15133

[21] Appl. No.: 561,945

[22] Filed: Aug. 1, 1990

[51] Int. Cl.[5] ..... A41D 13/00

[52] U.S. Cl. ..... 2/114; 2/106; 2/221; 2/DIG. 7

[58] Field of Search ..... 2/70, 71, 75, 80, 83, 2/105, 106, 114, 220, 221, 223, DIG. 6, DIG. 7

[56] References Cited

U.S. PATENT DOCUMENTS

| | | | |
|---|---|---|---|
| 646,194 | 3/1900 | Sims | 2/114 |
| 998,774 | 7/1911 | Howenstine | 2/221 |
| 1,122,737 | 12/1914 | Guinan | 2/221 |
| 1,141,284 | 6/1915 | Stone | 2/221 |
| 1,433,635 | 10/1922 | McMahan | 2/221 |
| 1,470,356 | 10/1923 | Graham | 2/83 |
| 2,148,344 | 2/1939 | Freedman | 2/70 |
| 2,493,531 | 1/1950 | Fitches | 2/115 |
| 2,703,404 | 3/1955 | Lawson | 2/80 X |
| 2,707,282 | 5/1955 | Paterson | 2/114 |
| 2,849,716 | 9/1958 | Kerson | 2/70 |
| 3,229,305 | 1/1966 | Nevilt | 2/114 |
| 3,470,568 | 10/1969 | Belkin | 2/114 |
| 3,824,625 | 7/1974 | Green | 2/DIG. 6 X |
| 3,877,078 | 4/1975 | Tepper | 2/90 |
| 4,578,825 | 4/1986 | Vote | 2/DIG. 7 |
| 4,590,624 | 5/1986 | Weiser | 2/114 |
| 4,653,120 | 3/1987 | Leof | 2/DIG. 7 |

FOREIGN PATENT DOCUMENTS

| | | | |
|---|---|---|---|
| 2700130 | 7/1978 | Fed. Rep. of Germany | 2/69 |
| 2192529 | 1/1988 | United Kingdom | 2/69 |

OTHER PUBLICATIONS

Velcro Publication: Dritz Velcro tape fasteners, Sep. 1972.

*Primary Examiner*—Werner H. Schroeder
*Assistant Examiner*—Jeanette E. Chapman
*Attorney, Agent, or Firm*—Webb, Burden, Ziesenheim & Webb

[57] ABSTRACT

The hospital gown has a top made of four pieces - two pieces for the right side (front and rear) and two pieces for the left side (front and rear). The two pieces are identical for the left side and the other two pieces are identical for the right side. The top of the gown has upward flaring body lines on each side of the neck cut-out, as in a butterfly wing. The sleeves are actually openings in the outer upper edges which extend about two-thirds the way down to the bottom of the top. The shoulders of a patient extend outwardly of the neck cut-out about one-fourth to one-third of the way to the outer edges such that the outer portions drop to form modesty sleeves which have no bottoms but open inwardly of the top to allow IV solution containers to pass therethrough without disconnecting the sterile connection to the patient. The bottom is a wrap-around panel. The back and front of the top include full length hook and loop fasteners, and the slide around panel bottom includes hook and loop fasteners plus a drawstring.

6 Claims, 3 Drawing Sheets

VERSATILE HOSPITAL AND OUT-PATIENT GOWN

BACKGROUND OF THE INVENTION

1. Field of the Invention

The invention relates to a hospital gown or gown for debilitated patients, out-patients, mental patients, and the like.

2. Description of the Prior Art

The present day hospital gowns are ill-fitting, ugly, embarrassing in exposure of various parts of the human body; degrading, dangerous to the point of life threatening, not adapted to modern technology (e.g.) some are not even X-ray compatible, waste staff time and even expose the institution to increased liability due to poor safety standards.

The present invention overcomes all of these shortcomings and much more.

SUMMARY OF THE INVENTION

The invention comprises a one size fits all top, openable fully or partially in both the front and rear. The top comprises an overlapping right or left side, made up of identical front and rear sections, and a smaller left or right overlapped side, made up of identical front and rear sections (since the respective sections of the sides are identical, the top is reversible and the right side may become-the left side). The inside gown and overlapping edges of the overlapping side carry either hooks or loops of fastening strips generally deployed vertically, and the forward edges of the overlapped side do not carry the opposite fastening strips but such strips are deployed in spaced relation to these forward edges, and on the outside of the overlapped side to receive the overlapping section fasteners. In this manner, the top is joined with all fasteners hidden from view. All four sections include a neck cut-out to comprise an oversized neck opening. The respective front and back sections are seamed together from their neck cut-outs to the outer edge of the section along rising lines flaring out from the neck region. Arm openings occupy about two-thirds of the outer edges of the sides commencing with the flared lines and extending downwardly. The bottom one-third or so of these outer edges seams together the respective front and back sections down to the bottom of the top.

The width of the flared length is great enough to permit the outer one-half to two-thirds to fall off the shoulder so the sleeve openings form something approaching a sleeve with an open backside into the garment top. The bottom of the gown is a wrap-around panel with one of hook and loop fasteners located at the front left top and bottom and the other of the loop and hook cooperating fasteners located at the rear right top and bottom so the bottom may be worn with all fasteners hidden. A drawstring is hemmed along the top inside but opens to the outside through a buttonhole or eyelet for snug tying.

DETAILED DESCRIPTION OF THE PREFERRED EMBODIMENT

Figure 1:
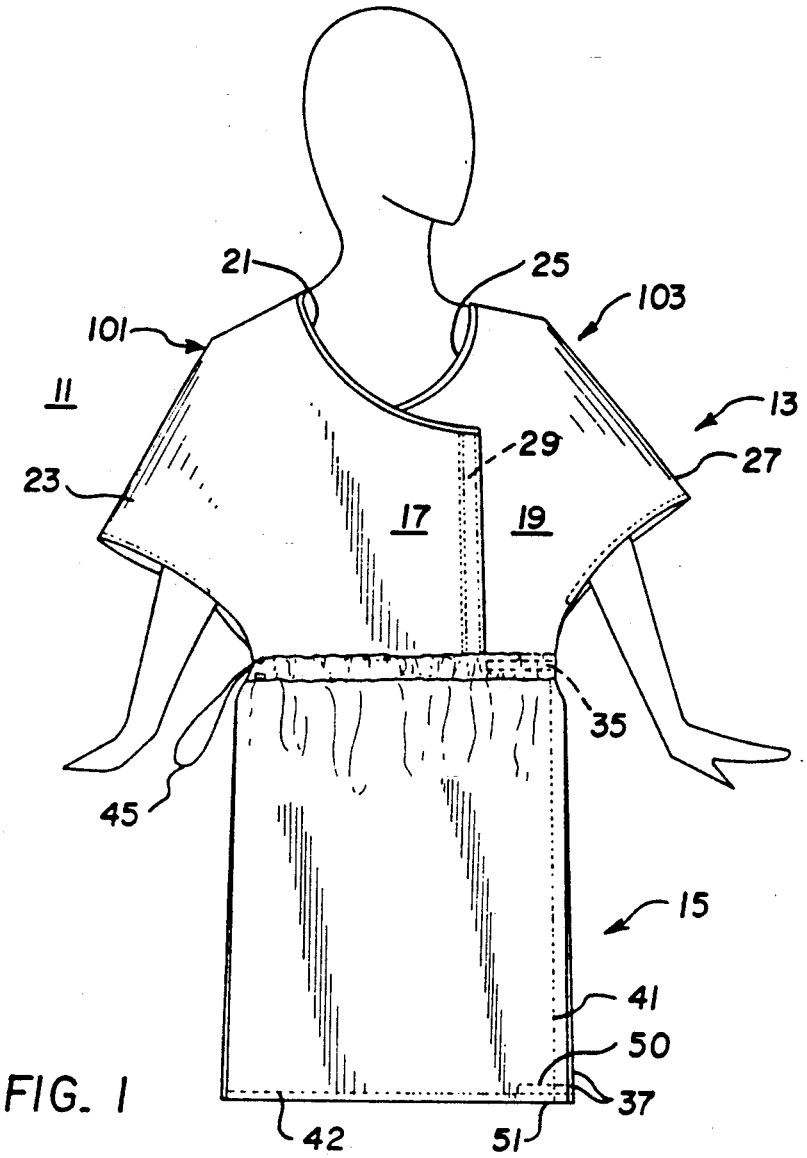
FIG. 1 is a front view of the gown on a portion of a mannequin.

In FIG. 1, the gown is shown at 11 having a top 13 and a bottom 15. The top includes an overlapping side 17 and an overlapped side 19. Side 17 includes a neck cut-out 21 and a sleeve 23, and side 19 includes a neck cut-out 25 and a sleeve 27. A hook and loop fastener 29 is shown hidden underneath side 17, holding the sides together.

The bottom 15 may comprise a rectangular wrap-around panel 15' (FIGS. 1 and 6) with hook or loop fastener strips 31, 33 at the front upper and lower corner regions (FIG. 6) with corresponding cooperating hook or loop fasteners 35 and 37 on the rear upper and lower corner regions. Dash lines 40, 41, 42 and 43 are a plurality of hem lines. Hem line 40 forms an elongated pocket for a drawstring 45 with the ends of the drawstring attached to opposite ends of the panel 15' and the draw loop passing out through a reinforced buttonhole 46.

Thus, when the wrap-around bottom 15' locates fastener 31 under fastener 35, all fasteners are hidden, and the bottom is roughly in place. Tightening drawstring 45 in FIG. 1 (which is exposed) comfortably locks the bottom in place. Fasteners 33 and 37 may be connected for additional modesty purposes. The fasteners (e.g.) 31 are strips of hook or loop material cut from a roll and sewn on the material of the garment, which is preferably 65-35 poly/cotton combination, to hospital specifications. The thread lines such as 50, 51, (FIG. 1) attaching the strips are the very edge of the hook or loop material (e.g.) 37 and, therefor in the drawings it is difficult to show the threads and hidden edges of the strips as they may be overlaid, but this explains the preferred manner of attaching the strips.

Returning now to FIGS. 1-5, the construction of the top will now be further detailed, and then the medical and safety reasons for the various constructional features will be set forth.

Figure 2:
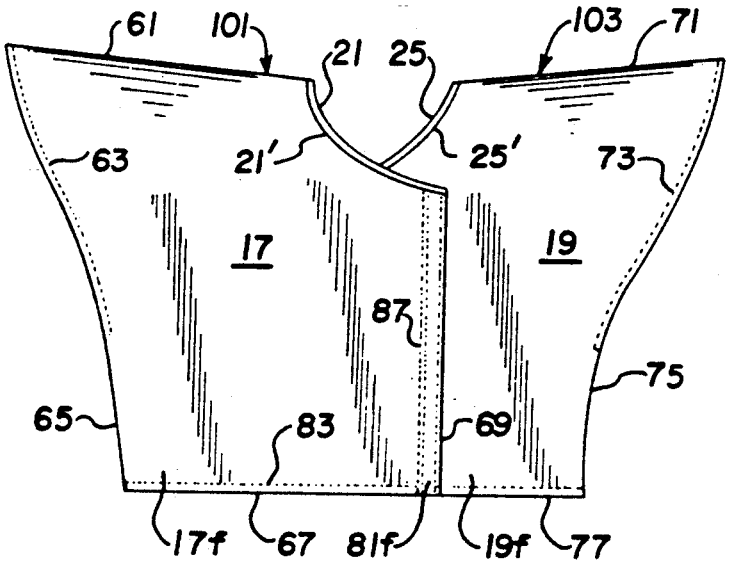
FIG. 2 is a front view of the top overlapping side and the top overlapped side in assembled relationship.
Figure 3:
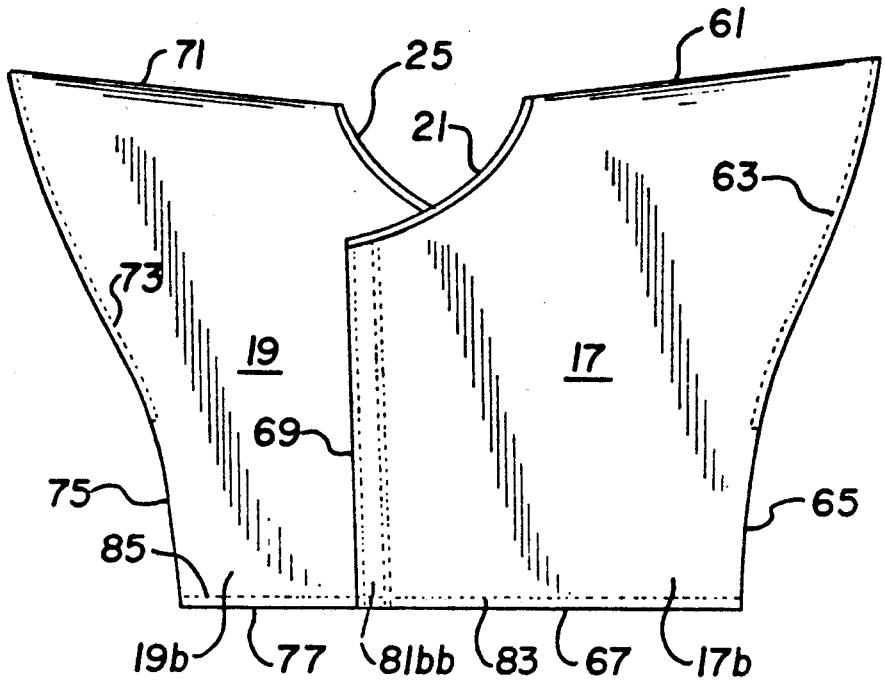
FIG. 3 is a rear view of the structure of FIG. 2.
Figure 4:
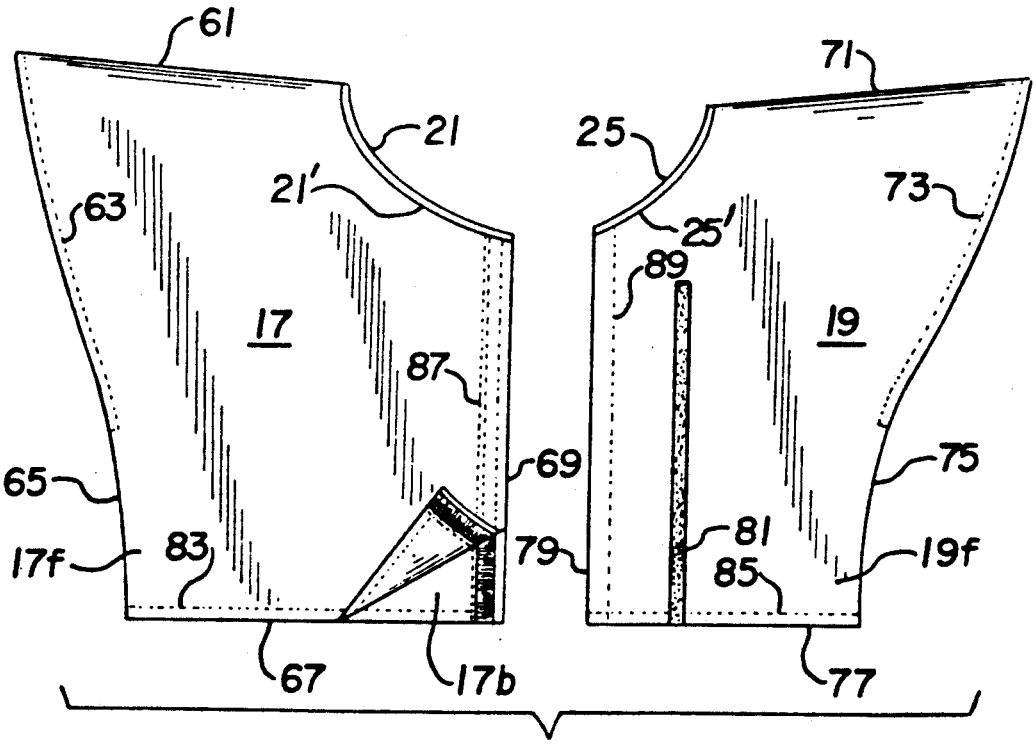
FIG. 4 shows the two sides prior to overlapping in front elevation.
Figure 5:
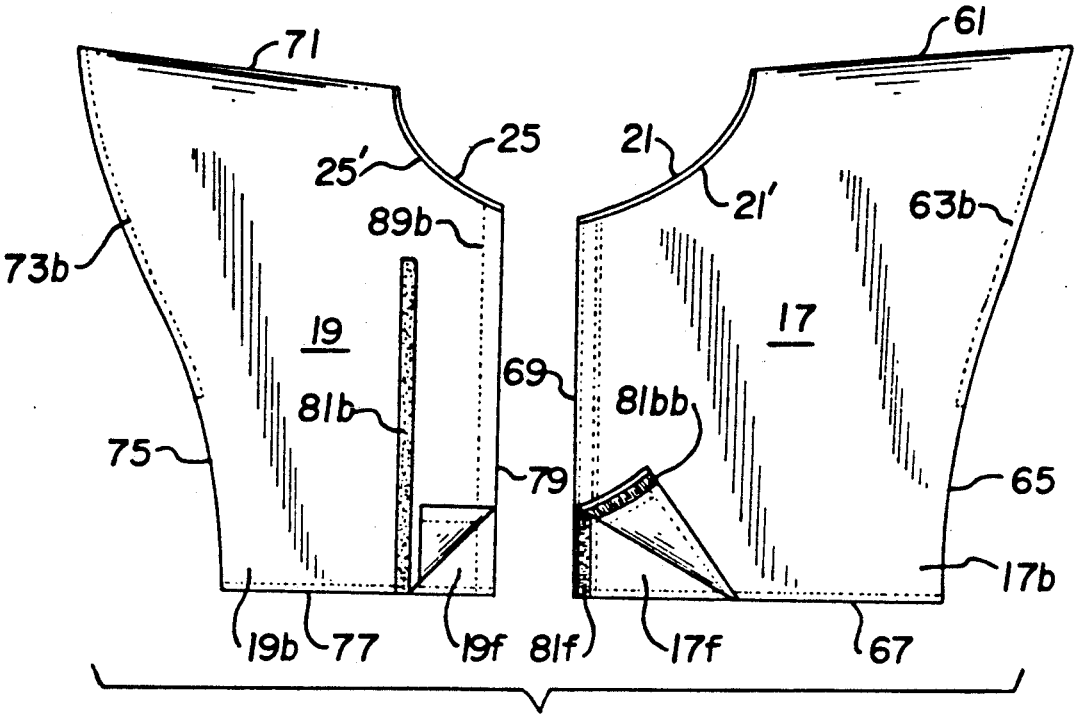
FIG. 5 is a rear view of the structure of FIG. 4.

FIGS. 2 and 3 show respectively the front and back of the completed top, whereas FIGS. 4 and 5 show the front and back of the sections and sides of the top prior to assembly.

In FIG. 4, the relative shapes of the sections of the top are shown. The overlapping side 17 is, of course, larger than the overlapped side 19. But, from FIG. 5, it is seen that the back sections **17*b* and 19*b* correspond exactly to the front sections 17*f* and 19*f***. This permits many layers of the material to be laid down, and the matching sections cut-out simultaneously for mass production.

In FIG. 4, by way of example, for overlapping side 17, neck cut-out 21 measures 10 inches. A top shoulder flare line 61 is about 15 inches and rises from cut-out 21 in the form of the forward edge of a butterfly wing. A hem 63 for the arm opening measures 18 inches and the overall left hand edge 65 is 27 inches. Bottom edge 67 on larger side 17 is 17 inches. The vertical right edge 69 measures 17 inches.

For the overlapped side 19, the neck cut-out is 8 inches, the flare line 71 is 15 inches. A hem 73 for the arm opening is 18 inches, the overall right hand edge 75 measures 27 inches, the bottom edge 77 is 13½ inches and the left hand edge 79 is 17½ inches. A fastener strip 81 is spaced from edge 79 at a distance of 4 inches.

In FIG. 4, a binding for the neck is shown at 21' and 25', a bottom hem line is shown at 83, 85 and a front center hem line at 87, 89. The flare lines 61, 71 are seamed to connect front 17*f* to back 17*b* and 19*f* to 19*b*. Also the edges 65 and 75 are seamed from the arm openings to the bottom edges 67, 77. This minimally seamed structure allows extra access to the patient, and the extra wide arm openings permit the IV solution container to be passed through the top while changing the patient without breaking sterility of tubing.

When the sides 17*f* and 17*b* of FIG. 5 overlap sides 19*f* and 19*b*, a hook or loop fastener 81*bb* of 17*b* connects with cooperating hook or loop fastener 81*b* of 19*b*, and a fastener 81*f* of 17 connects with fastener 81 of FIG. 4 to complete the top.

The operative top is shown in FIGS. 2 and 3. The arrow markers 101, 103 on flare lines 61, 71 show where the top edge breaks at the shoulders, corresponding to 101' and 103' in FIG. 1. For an average woman of about 116 pounds, these arrow marker points are about one-fourth the way from the outer edges of the neck cut-outs to the ends of flare lines 61, 71. For a husky man of 225 pounds, these markers move outwardly to only about one-third of the flare line 61, 71 lengths. Thus, it may be seen that the top will accommodate even larger sized persons while still providing modesty sleeves as well as room for large casts and dressings.

The distance between the top edges of cut-outs 21 and 25 is about 7 inches, but when a 225 pound man with a 17 inch neck wears the gown, two or more inches of extra neck room is presented on each side of his neck. However, this construction makes certain that the gown does not fall of the shoulders.

Figure 6:
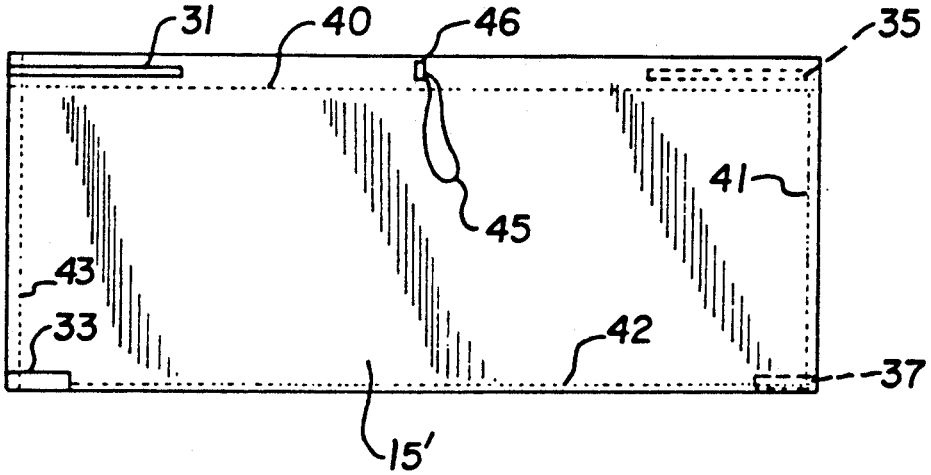
FIG. 6 is a front view of the wrap-around bottom panel.

It has been found that two sizes of bottoms are sufficient to cover the normal range of patients. In FIG. 6, the large size measures 44¾ by 25½-26 inches. The small size simply eliminates 10 inches from the length.

It is now known that mental and spiritual attitude are very important to the healing processes. The subject gown aids in creating a positive new image for the patient while protecting the patient from constriction and strangulation, protecting patient modesty while assisting the doctor and nurses in performing all necessary and emergency treatments, quickly.

The top can be opened front or back, partially or totally for routine and non-routine examinations and procedures. For example, IV insertions, breast examinations, lung, throat, and cardiac procedures, are conducted with total access instantly available for any need.

The bottom slides around on the patient to locate the hook and loop fastener opening, at will (e.g.) for abdominal exams, dressing changes, obstetrics—pre and post surgery exams and treatment. With the opening in the rear, rectal access is available for testing, examination and treatment.

A debilitated patient may suffer incontinence and only the bottom usually needs changing. Such savings in time, including better and quicker care reduce staff requirements relative to patient numbers. This can increase hospital efficiency and lower insurance rates and court losses in time and money. When necessary, the patient can be "log-rolled" if in extreme pain (e.g.) cancer, burn, or neuro-needs, (e.g.) spinal care, unconscious patients, etc.—the rectangular bottom is placed on his side, turned to the nurse, and then turned away to the other side extending panel bottom completely under the patient decreasing excess movements, pain, and permitting quick changes. It can also serve as a "lift" for a bed fast patient. Two team members raise the patient on the opened gown bottom—also to slide patient up while in bed. Dressing changes are facilitated by the universal access provided by this invention, and in turn supports sterility conditions, less time and less cost.

The gown is of course X-ray compatible, being free of buttons, zippers, snaps and other metal items.

The gown further admits of the patient putting it on backwards and only the direction of the overlap changes. It also permits instant disassembly to be placed on patients over casts.

The dimensions of top 13 are such that the top is shorter on most patients than conventional hospital gowns and is raised above the pubic area. This reduces the changes for the top to get wet and reduces the frequency with which the top must be changed.

The dimensions of neck cut-outs 21, 25 offer reduced constriction to the patient's neck while at the same time accommodating patients of widely varying size.

What is claimed is:

1. A patient gown top enabling access for diagnosis including testing, treatment and care, comprising:

a left side having a front left side and an identical back left side with a left neck cut-out, said front and back left sides being joined together along a first shoulder seam which extends upward from a top of the left neck cut-out to a left side outer edge so that the left side resembles a butterfly wing;

a left arm opening defined by said front and back left sides and extending from said first shoulder seam downward approximately two-thirds a length along said left side outer edge;

a left outer edge seam extending from a bottom of said arm opening to a bottom of the left side;

a first fastener secured to the front and back left sides on the outsides thereof at respective locations spaced inwardly of a left side vertical inner edge, said inner edge extending from a bottom of the left neck cut-out to the bottom of the left side;

a right side having a front right side and back right side with a right neck cut-out, said front and back right sides being joined together along a second shoulder seam which extends upward from a top of the right neck cut-out to a right side outer edge so that the right side resembles a butterfly wing;

a right arm opening defined by said front and back right sides and extending from said second shoulder seam downward approximately two-thirds a length along said right side outer edge;

a right outer edge seam extending from a bottom of said arm opening to a bottom of the right side; and a second fastener secured to the front and back right sides on the insides thereof at respective locations along a vertical right side inner edge, which extends from a bottom of the right neck cut-out to the bottom of the right side;

said right side overlapping said left side with said second fasteners engaging said first fasteners to secure said right side and said left side, the shoulders of a patient engaging an inside of said shoulder seams at spaced locations from said neck cut-outs, thereby draping an outer portion of each shoulder seam downward along the patient's arms to form a simulated sleeve with an open axilla.

2. The patient gown top of claim 1 wherein the neck cut-outs and the shoulder seams are dimensioned so that the patient's shoulders extend approximately one-fourth to one-third a length along the shoulder seams.

3. The patient gown top of claim 1 wherein the neck cut-outs define an opening with approximately twice the cross-sectional area of a patient's neck when said right side is engaged on said left side.

4. The patient gown top of claim 1 wherein said first fastener is one of a hook or loop closure and said second fastener is the other of said hook or loop closure.

5. The patient gown top of claim 1 including a separable wrap-around bottom comprising a rectangular hemmed panel having a first fastener on a front of said panel at a top and a bottom left corner, with a second fastener correspondingly located on a back of said panel at a top and a bottom right corner, and further including a drawstring hemmed in an upper edge of said panel, said panel further including an eyelet in a front upper edge for outward extension of said drawstring, whereby said panel is wrapped around a lower torso of the patient with the first fasteners engaging the second fasteners and with the drawstring tightened to fit.

6. A patient gown enabling access for diagnosis including testing, treatment and care, comprising:

a top left side having a front left side and an identical back left side with a left neck cut-out, said front and back left sides being joined together along a first shoulder seam which extends upward from a top of the left neck cut-out to a left side outer edge so that the left side resembles a butterfly wing;

a left arm opening defined by said front and back left sides and extending from said first shoulder seam downward approximately two-thirds a length along said left side outer edge;

a left outer edge seam extending from a bottom of said arm opening to a bottom of the left side;

a first fastener secured to the front and back left sides on the outsides thereof at respective locations spaced inwardly of a left side vertical inner edge, which extends from a bottom of the left neck cut-out to the bottom of the left side;

a top right side having a front right side and a back right side with a right neck cut-out, said front and back right sides being joined together along a second shoulder seam which extends upward from a top of the right neck cut-out to a right side outer edge so that the right side resembles a butterfly wing;

a right arm opening defined by said front and back right sides and extending from said second shoulder seam downward approximately two-thirds a length along said right side outer edge;

a right outer edge seam extending from a bottom of said arm opening to a bottom of the right side;

a second fastener secured to the front and back right sides on the insides thereof at respective locations along a vertical right side inner edge, which extends from a bottom of the right neck cut-out to the bottom of the right side;

said right side overlapping said left side with said second fasteners engaging said first fasteners to secure said right side and said left side, the shoulders of a patient engaging an inside of said shoulder seams at spaced locations from said neck cut-outs, thereby draping an outer portion of each shoulder seam downward along the patient's arms to form a simulated sleeve with an open axilla; and a separable wrap-around bottom comprising a rectangular hemmed panel having a first fastener on a front of said panel at a top and a bottom left corner, with a second fastener correspondingly located on a back of said panel at a top and a bottom right corner, and further including a drawstring hemmed in an upper edge of said panel, said panel further including an eyelet in a front upper edge for outward extension of said drawstring, whereby said panel is wrapped around a lower torso of the patient with the first fasteners engaging the corresponding second fasteners and with the drawstring tightened to fit.

* * * * *